United States Patent [19]

Viaud et al.

[11] Patent Number: 4,967,040

[45] Date of Patent: Oct. 30, 1990

[54] SCREENED ELECTRIC CABLE PROVIDED WITH ZONES FOR RAPID PARALLEL CONNECTION

[75] Inventors: André Viaud, Crosne; François Vaille, Corbeil, both of France

[73] Assignee: Societe Anonyme dite: FILOTEX, Draveil, France

[21] Appl. No.: 449,212

[22] Filed: Dec. 12, 1989

[30] Foreign Application Priority Data

Dec. 13, 1988 [FR] France ..... 88 16377

[51] Int. Cl.[5] ..... H01B 7/08; H01B 7/36

[52] U.S. Cl. ..... 174/36; 174/72 R; 174/112; 174/115; 174/117 F

[58] Field of Search ..... 174/36, 71 R, 72 R, 174/72 TR, 112, 115, 116, 117 R, 117 F

[56] References Cited

U.S. PATENT DOCUMENTS

| | | | |
|---|---|---|---|
| 3,728,661 | 4/1973 | Kassabgi | 174/117 FF X |
| 3,775,552 | 11/1973 | Schumacher | 174/117 F X |
| 4,066,840 | 1/1978 | Allgaier | 174/72 R |
| 4,837,405 | 6/1989 | Bonjour et al. | 174/36 |

FOREIGN PATENT DOCUMENTS

| | | | |
|---|---|---|---|
| 1221818 | 1/1960 | France . | |
| 2519797 | 7/1983 | France | 174/117 F |
| 2663091 | 12/1989 | France | 174/72 TR |
| 1432548 | 4/1976 | United Kingdom | 174/112 |

*Primary Examiner*—Laramie E. Askin

*Attorney, Agent, or Firm*—Sughrue, Mion, Zinn, Macpeak & Seas

[57] ABSTRACT

A multi-conductor screened electric cable in which each conductor may be connected in parallel to an elelctrical contact without having to break the cable. Such connections are made in predetermined zones of the cable. All of the conductors of the predetermined zones are parallel and lie in a plane. In addition to its insulated conductors, the cable includes an uninsulated conductor element (5) providing electrical continuity for its screening (6), and also making it possible to make an electrical contact with the screening. The insulated conductors (3, 4) and the uninsulated conductor element (8) are disposed at predetermined accurate distances relative to one another. The cable is particularly suitable for computer networks.

6 Claims, 3 Drawing Sheets

SCREENED ELECTRIC CABLE PROVIDED WITH ZONES FOR RAPID PARALLEL CONNECTION

BACKGROUND OF THE INVENTION

The present invention provides a multi-conductor screened electric cable in which each conductor may be connected in parallel to an electrical contact without breaking the cable, said connections being makable in predetermined zones of the cable, said zones being short relative to the distances between two successive zones, with all of the conductors therein being parallel to one another and contained in a plane.

In French patent application No. 88 08 141 filed June 17, 1988 and published Dec. 22, 1989 under the No. 2,633,091, the present applicants have already proposed a multi-conductor cable provided with loops for use in providing parallel connections and including one or more electrical conductors housed together in a covering, having lateral loops from place to place constituted by excess lengths of some conductors which extend outside the covering and are available for connections in parallel relative to the connection provided by the cable.

However, such a cable does not provide very good protection for the loop-shaped conductors in the connection zones, since in these zones the conductors are outside the covering of the cable.

The object of the invention is to provide an electrical cable making it possible to provide parallel connections between its own conductors and electrical contacts, e.g. of the wire-stripping type, but providing better protection for the conductors in the connection zones by virtue of the fact that they do not project outside the covering.

SUMMARY OF THE INVENTION

In each connection zone of a cable of the invention:

(a) there exists an uninsulated conductor element in addition to conductors covered in insulation, thereby providing electrical continuity for the screening from one end to the other of the connection zone and also making it possible to provide a parallel connection between the screening and an electrical contact; and (b) the insulated conductors and the uninsulated conductor element are disposed at precise and predetermined distances relative to one another.

In addition, the cable preferably satisfies at least one of the following features:

it also includes, at least in the connection zones, an insulating element constituting a separator between the uninsulated conductor element and the insulated conductors;

the uninsulated element is disposed between two insulated conductors;

that the uninsulated conductor element is disposed at one of the ends of the alignment of conductors; and it includes an insulating covering, which covering includes marks for identifying the connection zones, or is made of translucent material.

BRIEF DESCRIPTION OF THE DRAWINGS

Cables in accordance with the invention, including a cable whose conductors outside the connection zones are twisted, and a cable which is flat in structure, are described below by way of example and with reference to the figures of the accompanying drawings, in which.

DETAILED DESCRIPTION

Figure 1:
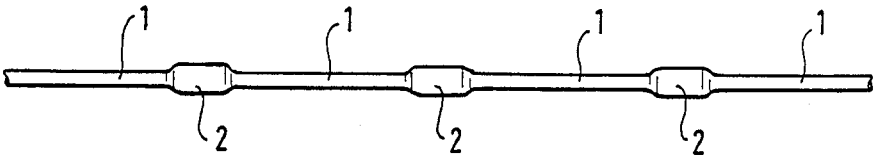
FIG. 1 shows the general appearance of a cable in accordance with the invention, including connection zones from place to place.

In FIG. 1, a cable in accordance with the invention comprises running zones 1 together with connection zones 2 disposed from place to place. The lengths of the running zones are measured in decimeters to decameters, and the lengths of the connection zones are measured in millimeters to centimeters. The lengths of the running zones between successive connection zones may be identical or different depending on the intended connection plan.

Figure 2:
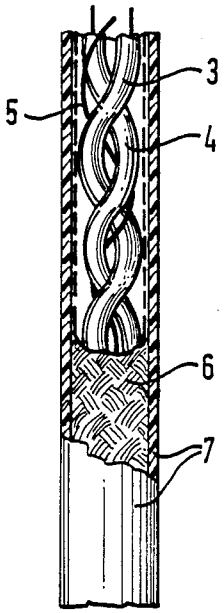
FIG. 2 is a longitudinal section through a screened cable comprising a plurality of twisted conductors, with the section being outside a connection zone.
Figure 3:
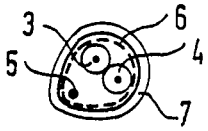
FIG. 3 is a cross-section through the same cable outside a connection zone.

In FIGS. 2 and 3, the running zone of a twisted conductor cable comprises two insulated conductors 3 and 4, a metal screen 6, and an insulating sheath 7.

Using techniques known to the person skilled in the art, the electrical screen may either be constituted by a tube made from metal tape or plastic tape coated with metal on one or both of its faces, or else from a braid or a lapping or a woven cloth of metal threads.

If the screen is constituted by a tube, it is common for a drain conductor 5 to be placed in contact with the screen along the cable so as to facilitate making connections between the screen and electrical contacts disposed at the ends of the cable or along the cable. The drain conductor is not covered in insulation and it may be constituted by a single strand or by a plurality of strands twisted together.

Although less common, the same disposition may be adopted when the screen is constituted by a metal braid, cloth, or lapping. FIGS. 2 and 3 show such a drain conductor, but it should be understood that the invention is equally applicable to screened cables with drain conductors, and to screened cables without them.

Figure 4:
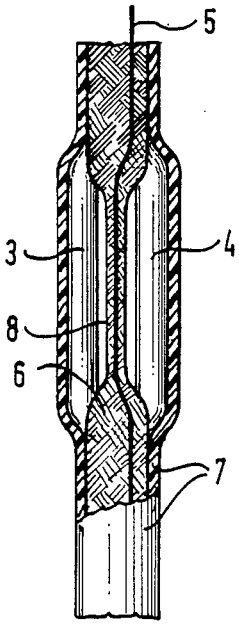
FIG. 4 is a longitudinal section of the same cable in a connection zone.
Figure 5:
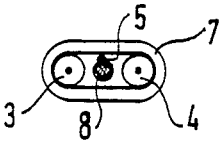
FIG. 5 is a cross-section through the same cable in a connection zone.

FIGS. 4 and 5 show connection zones in accordance with the invention in a cable whose screen is constituted by a metal braid 6 together with a drain conductor 5.

In said zone, the elements of the braid are brought together to constitute a single substantially wire-shaped conductor 8 having the drain conductor 5 pressed thereagainst.

When the cable is provided with a screen constituted by a tape, the conductor element 8 may be constituted by an add-on element whose ends make contact with lengths of screen at either end of the connection zone per se. Alternatively, it may be constituted merely by the single drain conductor 5, if the cable is provided with such a conductor.

Figure 6:
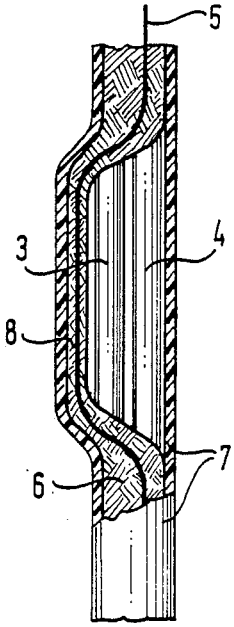
FIG. 6 is a longitudinal section through a variant of the screened cable in which the uninsulated conductor element is disposed outside the insulated conductors.
Figure 7:
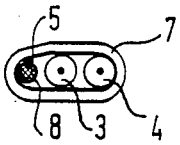
FIG. 7 is a cross-section through the FIG. 6 variant.

The conductors are aligned in a plane with the conductor element 8, and the conductor element 8 may be disposed between the conductors (FIGS. 4–5) or outside them (FIGS. 6–7). When the drain conductor 5 is provided, it remains in contact with the conductor element 8 interconnecting the screen elements 6.

Figure 8:
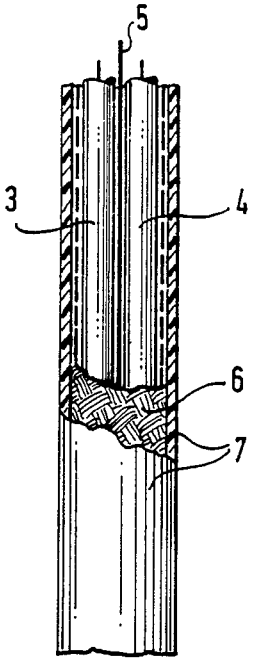
FIG. 8 is a longitudinal section through a flat screened cable outside a connection zone.
Figure 9:
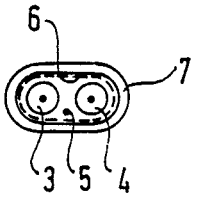
FIG. 9 shows the flat cable of FIG. 8 in cross-section outside a connection zone.

FIGS. 8 and 9 show the running zone of a flat cable in which the conductors 3 and 4 are disposed side by side inside the screen 6 and the insulating sheath 7.

In this case, the screen is preferably constituted by a metal braid or woven cloth and there is no drain conductor. However, the screen could equally well be constituted by a tape optionally accompanied by a drain conductor.

Figure 10:
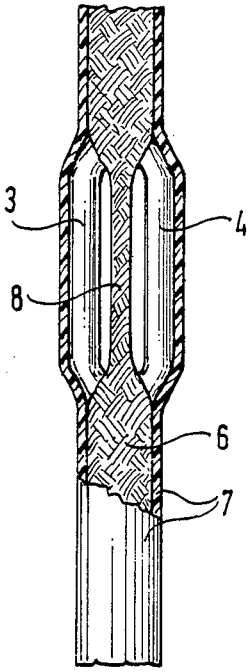
FIG. 10 is a longitudinal section through a connection zone of a flat screened cable.
Figure 11:
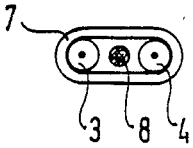
FIG. 11 is a cross-section through the FIG. 10 connection zone.

In a connection zone of such a cable, as shown in FIGS. 10 and 11, the conductor element 8 is disposed between the insulated conductors 3 and 4 and interconnects the two ends of the screen at opposite ends of the connection zone. It is constituted by bringing together the conductor elements in the braid.

The invention is described above using the example of cables having two insulated conductors. The person skilled in the art will readily understand that it is applicable in the same way to cables having several insulated conductors or including one or more non-conducting elements commonly referred to as fillers or separators.

Figure 12:
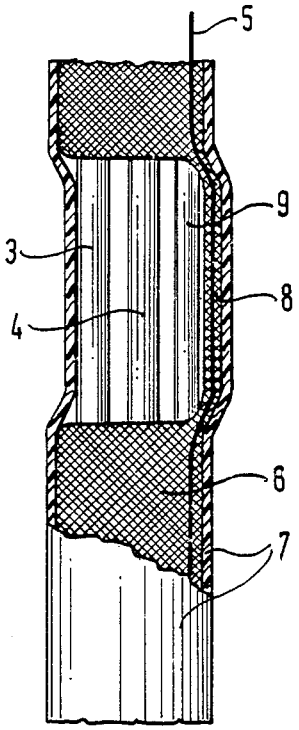
FIGS. 12 and 13 are a longitudinal section and a cross-section through a flat cable in which the uninsulated conductor element is maintained at an accurate distance from the other conductors.
Figure 13:
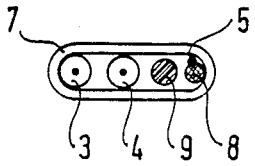

Such a situation sometimes occurs in flat cables where such a separator element may be inserted to one side of the set of insulated conductors in order to ensure that an accurate distance is maintained between the uninsulated drain conductor and the adjacent insulated conductor. The separator element may be inserted in connection zones only, or it may exist in the running portions of the cable, as well. FIGS. 12 and 13 show a cable in which the separator element 9 exists both in the connection zones and in the remainder of the cable.

In the connection zones of FIGS. 10 and 11, it is likewise possible to enforce accurate distances between the conductor element 8 and the insulated conductors 3 and 4 by inserting a separator on either side of the conductor element 8.

Such dispositions make it possible to make connections with all of the conductor elements by means of connection systems having an accurate pitch between contacts.

In all of the embodiments described above, the insulating covering or sheath 7 may be made of translucent material or may include marks identifying the connection zones.

Cables of the invention are particularly suited for constructing computer networks in which it often happens that equipment needs to be added or removed along a line or changed in position without interrupting the operation of other equipment, or without even disturbing them momentarily.

We claim:

1. A multi-conductor electric cable comprising at least two insulated conductors, a metallic screen surrounding said conductors, each conductor being connectable in parallel to an electrical contact without cutting the cable, said connections being makable in predetermined zones of the cable, said zones being short relative to the distance between two successive zones, with all of the conductors in each zone being parallel to one another and contained in a plane, and wherein, in each connection zone said cable further comprises:

(a) an uninsulated conductor element in addition to said at least two insulated conductors, said uninsulated conductor element being in electrical contact with the screen of the electric cable at both ends of said connection zone, thereby providing electrical continuity for the screen from one end to the other of the connection zone and also making it possible to provide a parallel connection between the screening and an electrical contact, and wherein:

(b) the at least two insulated conductors and the uninsulated conductor element are disposed at precise and predetermined distances relative to one another, and (c) the metallic screen is substantially devoid of the periphery of the cable, and wherein outside of said connection zones said metallic screen fully surrounds the conductors.

2. A cable according to claim 1, further including, at least in the connection zones, an insulating element constituting a separator between the uninsulated conductor element and said at least two insulated conductors.

3. A cable according to claim 1, wherein said uninsulated conductor element is disposed in the connection zones between said at least two insulated conductors.

4. A cable according to claim 1, wherein said uninsulated conductor element is disposed in the connection zones laterally outside of said at least two insulated conductors.

5. A cable according to claim 1, wherein the cable includes an insulating covering, which covering includes identification marks in the connection zones.

6. A cable according to claim 1, wherein the cable includes in the connection zones an insulating covering made of translucent material.

* * * * *